US012698012B2

(12) United States Patent
Bleth et al.

(10) Patent No.: US 12,698,012 B2
(45) Date of Patent: Aug. 4, 2026

(54) END CAB SWITCHER LOCOMOTIVE

(71) Applicant: Siemens Mobility GmbH, Munich (DE)

(72) Inventors: Sebastian Bleth, Munich (DE); Jörg Melde, Olching (DE); Hannes Peer, Munich (DE); Jörg Pforr, Moosach (DE); Manuel Rüttiger, Herrsching (DE)

(73) Assignee: Siemens Mobility GmbH, Munich (DE)

( * ) Notice: Subject to any disclaimer, the term of this patent is extended or adjusted under 35 U.S.C. 154(b) by 509 days.

(21) Appl. No.: 18/263,743

(22) PCT Filed: Dec. 16, 2021

(86) PCT No.: PCT/EP2021/086053
§ 371 (c)(1),
(2) Date: Aug. 1, 2023

(87) PCT Pub. No.: WO2022/161697
PCT Pub. Date: Aug. 4, 2022

(65) Prior Publication Data

US 2024/0317279 A1 Sep. 26, 2024

(30) Foreign Application Priority Data

Feb. 1, 2021 (DE) ..... 10 2021 200 852.6

(51) Int. Cl.
*B61C 17/04* (2006.01)
*B61C 13/00* (2006.01)
(Continued)

(52) U.S. Cl.
CPC ..... *B61C 17/04* (2013.01); *B61C 13/00* (2013.01); *B61D 15/06* (2013.01); *B61D 23/00* (2013.01);
(Continued)

(58) Field of Classification Search
CPC ..... B61C 17/04; B61C 13/00; B61D 15/06; B61D 17/06; B61D 23/00; B61G 11/18;
(Continued)

(56) References Cited

U.S. PATENT DOCUMENTS 301,326 A * 7/1884 Baker et al. ..... B60R 3/02 182/91
406,726 A 7/1889 Groswith
(Continued)

FOREIGN PATENT DOCUMENTS

CN 201432678 Y 3/2010
CN 202952993 U 5/2013
(Continued)

OTHER PUBLICATIONS

Intergovernmental Organisation for International Carriage by Rail (OTIF). "Uniform Technical Prescriptions Applicable to the Rolling Stock Subsystem: Freight Wagons, Consolidated Version", 2016, OTIF, Berne, Switzerland.
(Continued)

*Primary Examiner* — Zachary L Kuhfuss
(74) *Attorney, Agent, or Firm* — Laurence A. Greenberg; Werner H. Stemer; Ralph E. Locher

(57) ABSTRACT

An end cab switcher locomotive includes buffer systems, an end cab and a switchman's footstep in front of the end cab on the side of a first one of the buffer systems. The switchman's footstep is disposed in such a way that when the buffer of the first buffer system is completely elastically pushed in, its buffer plane lies in front of the switchman's footstep. A corresponding buffer system for an end cab locomotive is also provided.

17 Claims, 4 Drawing Sheets

(51) Int. Cl.

| | |
|---|---|
| ***B61D 15/06*** | (2006.01) |
| ***B61D 23/00*** | (2006.01) |
| ***B61G 11/18*** | (2006.01) |
| ***B61J 3/12*** | (2006.01) |
| *B61D 17/06* | (2006.01) |

(52) U.S. Cl.
CPC ..... *B61G 11/18* (2013.01); *B61J 3/12* (2013.01); *B61D 17/06* (2013.01)

(58) Field of Classification Search
CPC ..... B61G 7/08; B61G 7/10; B61G 7/12; B61J 3/12
USPC ..... 105/460
See application file for complete search history.

(56) References Cited

U.S. PATENT DOCUMENTS

| | | | |
|---|---|---|---|
| 4,067,264 | A | 1/1978 | Ensink |
| 2011/0265685 | A1 | 11/2011 | Swygert |

FOREIGN PATENT DOCUMENTS

| | | | | |
|---|---|---|---|---|
| DE | 2931909 | A1 | 2/1981 | |
| DE | 8127634 | U1 | 10/1983 | |
| DE | 19809489 | A1 * | 7/1999 | ..... B61G 11/16 |
| DE | 102006006159 | A1 | 8/2007 | |
| DE | 102006033161 | A1 | 1/2008 | |
| EP | 0816197 | A2 | 1/1998 | |
| EP | 3530544 | A1 | 8/2019 | |
| FR | 2458438 | A1 * | 1/1981 | ..... B61C 17/04 |
| GB | 17054 | A | 10/1910 | |

OTHER PUBLICATIONS

Lok Report, "Deutsche Bahn: DB Cargo concludes framework agreement with Siemens for up to 400 dual-mode locomotives", Lok-Report, Sep. 2020, Lok-Report Online, Germany, https://www.lok-report.de/news/deutschland/industrie/item/20025-deutsche-bahn-db-cargo-schliesst-rahmenvertrag-mit-siemens-ueber-biszu-400-zweikraftloks-ab.html.

Norm DIN EN 16116-1 2014-01-00.; "Bahnanwendungen—Konstruktionsanforderungen an Tritte, Handgriffe und zugehörige Zugänge für das Personal—Teil 1: Personenfahrzeuge, Gepäckwagen und Lokomotiven; Deutsche Fassung"; EN 16116-1:2013 [Railway applications—Design requirements for steps, handrails and associated access for staff—Part 1: Passenger vehicles, luggage vans and locomotives: German version EN 16116-1:2013]—English abstract.

Norm DIN EN 16116-2 2014-01-00.; "Bahnanwendungen—Konstruktionsanforderungen an Tritte, Handgriffe und zugehörige Zugänge für das Personal—Teil 2: Güterwagen; Deutsche Fassung"; EN 16116-2:2013 [Railway applications—Design requirements for steps, handrails and associated for staff—Part 2: Freight wagons; German version EN 16116-2:2013—English abstract.

CTK: "Zeleznicni .silacl' doplni Figuren vozovy park Ceskych drah"; Vyjdou na ctvrt miliardy.; lidwoky.cz, Jul. 24, 2017. URL: https://www.lidovky.cz/byznys/zeleznicni-silaci-doplni-vozovypark-ceskych-drah-vyjdou-nactvrtmiliardy .A170724_123518_statni-pokladna_pave; [retrieved on Oct. 16, 2021]—photos attached.

"DB Cargo und Siemens Mobility Figur schließen Rahmenvertag über 400 Zweikraftloks vom Typ Vectron Dual Mode ab"; [DB Cargo and Siemens Mobility conclude framework agreement for 400 Vectron Dual Mode locomotives] Siemens Mobility GmbH; Aug. 9, 2020. URL: https://press.siemens.com/global/de/feature/db-cargo-und-siemens-mobility-schliessen-rahmenvertrag-ueber-400-zweikraftloks-vom-typ; [retrieved on Oct. 16, 2021]—photo attached.

ERA/TD/2012-04/INT, Version 1.3, Feb. 2014—European Railway Agency—Technical specifications for interoperability (TSIs)—Abstract.

Fricke Joachim: "Sonderzug der Erinnerung mit V160 002 im Vorharz/ Rückblick" [Special train of remembrance with V160 002 in the pre-Harz / review], Bahn Nostalgie Reisen, (May 15, 2016), XP093042197, found on the internet: URL: https://www.bahn-nostalgie-reisen.de/sonderzug-der-erinnerung-imvorharz—English version.

* cited by examiner

END CAB SWITCHER LOCOMOTIVE

FIELD AND BACKGROUND OF THE INVENTION

The invention relates to an end cab locomotive for switching operations, in particular to a special front end arrangement with one switchman's stand or a plurality of switchman's stands.

For rail vehicles having end cabs, the attachments and the arrangement thereof in the front end region are precisely regulated by current standards and guidelines, e.g. the dimensions and arrangements of a pull and/or push device, a crash system, the brake line connections or spaces to be kept free (e.g. the Berner rectangle). In particular, the space provided at the corners of the front end region (or "of the front end regions", depending on the use) of an end cab locomotive is restricted by diverse attachments, e.g. crash elements, actuations for couplings, contour of the front end nose, in such a manner that an arrangement, which is customary for switcher locomotives having a central driver's cab, of footsteps, stands and handlebars for switching purposes in accordance with a standard (e.g. EN16116-1 or -2) and the resulting spaces to be kept free for handlebars and switchman's footsteps can be realized only with difficulty, if at all because of a lack of space.

Up to now, an arrangement of switchman's stands, which means here a combination of a switchman's footstep (or a standing surface) and a handle (or a banister), has not been possible in the front end region of an end cab locomotive as an addition to the attachments already present. It should be noted that a switchman's footstep according to current standards (EN16116 or TSI WAG CR) has to have a footstep surface which is at least 350×350 mm. Standard switchman's stands have hitherto been known only in the case of central cab locomotives.

End cab locomotives which are provided with a (too small) switchman's footstep instead of the apron which is otherwise present, in order to be able to carry out switching activities, are already known. Although the footstep surface is too small, generally, in the case of locomotives equipped in such a way, the clearance gauge, the minimum distance from fixed components when the buffers are completely compressed, and the required clearance for the switchman below the buffer (in order to get into the Berner rectangle) are not kept to.

The greatest challenge here is keeping to the current standards and guidelines. For example, a large footstep surface and a handle reaching as far as the shoulder are required for a switchman's stand.

SUMMARY OF THE INVENTION

It is an object of the present invention to specify an end cab locomotive for switching operations, with which the above-described disadvantages are avoided and in particular a reliable switching operation with a switchman's stand is ensured. The object resides in particular in integrating a switchman's stand, despite the space problems which are present, in accordance with the current standards and guidelines in the existing front end arrangement for rail vehicles having end cabs.

This object is achieved by an end cab locomotive and by a buffer system as described below.

An end cab locomotive according to the invention for switching operations comprises buffer systems, an end cab and a switchman's footstep in front of the end cab on the side of a first buffer system. In this case, the switchman's footstep is arranged in such a manner that, when the buffer is completely elastically pushed in, the buffer plane lies in front of the switchman's footstep. The space above the switchman's footstep, i.e. the space which is spanned by the vertical projection of the switchman's footstep, therefore lies outside the clearance of the first buffer system.

The end cab locomotive preferably comprises two end cabs at each end of the end cab locomotive and, particularly preferably, at least one switchman's stand at each of said ends, in particular in each case on the right side in the direction of travel of the relevant end cab. In addition, the end cab locomotive comprises the customary further components, e.g. a coupling, wherein preferably there are in each case two buffer systems at each end, which are arranged on the right and on the left of the coupling. The switchman's stand is located on the side of the end cab locomotive and not between the buffer systems. It should be noted that the buffer planes of two buffer systems lying next to each other (in their relaxed states) are intended to lie in the same plane.

Each of the buffer systems comprises a buffer flange, which is attached to the buffer housing (formed from the buffer sleeve and buffer plunger and optionally a rotation lock), and a buffer plate. The buffer plane (also called "impact plane" or "contact plane") is a plane lying tangentially to the buffer surfaces of the two buffer plates at the end of the vehicle and perpendicularly to the travelling surface. The buffer systems are preferably extended in comparison to conventional buffer systems, and therefore between the end cab and the buffer plane (when the buffers are relaxed) there is a rectangular space region with a depth of at least 350 mm for the switchman's footstep plus a clearance of at least 150 mm (for the complete pushing-in of the buffers). As is noted, the total length of the buffer systems may also be significantly larger since the attachment point of the buffer systems to the frame of the end cab locomotive may lie completely behind the switchman's footstep. This extension of the buffer systems achieves the required space for integrating a switchman's stand.

A buffer flange is frequently also referred to as a "buffer (base) plate". A distinction is generally made between end flanges (attached to the end of a buffer housing) and central flanges (pushed onto a buffer housing and attached in particular in the region of the center). The attachment surface with which a buffer is screwed to a buffer beam or a crash element with the buffer screws is involved here. The buffer housing comprises a buffer sleeve and buffer plunger (and optionally a rotation lock).

A buffer system according to the invention is designed for an end cab locomotive according to the invention and comprises a buffer with a buffer plate and a buffer flange. The buffer system is configured here in such a manner that, after attachment to the end cab locomotive, a distance of the buffer plane of the buffer system from the switchman's footstep of the end cab locomotive has a clearance of at least 150 mm in length, in particular at least 300 mm, on this side.

Such a buffer system preferably additionally comprises a crash element with a receiving space in the center thereof, wherein the buffer projects with its buffer housing (i.e. the buffer sleeve or the buffer plunger) into the receiving 19 space. Part of the buffer housing is therefore located in the interior of the crash element and is fastened here with a buffer flange to the crash element. This buffer flange surrounds the buffer housing (i.e. the buffer sleeve or the buffer plunger) projecting into the receiving space. Such a buffer is often referred to as a "central flange buffer".

Further particularly advantageous embodiments and refinements of the invention will emerge from the dependent claims and from the following description, wherein the claims of one claim category may also be refined analogously to the claims and description parts of another claim category, and in particular also individual features of different exemplary embodiments or variants may be combined to form new exemplary embodiments or variants.

According to a preferred embodiment, the first buffer system is extended in such a manner that the front edge of the switchman's footstep, preferably a switchman's stand, is at least 150 mm, preferably at least 300 mm, away from the buffer plane of the relaxed buffer system. Since buffer systems are generally present in pairs at the ends of the locomotive, the same preferably also applies to the further buffer system on the relevant end cab. The distance applies in particular to a switchman's stand since the latter because of the handle may be somewhat larger than the switchman's footstep, which furthermore preferably has a length of at least 350 mm, in particular at least 500 mm, since a person is intended to be able to comfortably stand thereon.

According to a preferred embodiment, a buffer system of the end cab locomotive has a spacer on the buffer flange on the side facing away from the buffer plate, and/or the buffer system has an extension in the longitudinal direction between the buffer flange and buffer plate plane. A buffer flange which surrounds the buffer housing is preferably displaced rearward in comparison to a conventional buffer, and therefore the distance between the buffer plate and buffer flange is greater.

According to a preferred embodiment, the buffer system of the end cab locomotive comprises a crash element. A spacer is preferably arranged between the crash element and buffer flange. Alternatively or additionally, the buffer partially projects into the crash element. The buffer flange is then preferably attached to the buffer housing in such a manner that there is a Berner rectangle with a depth of at least 35 cm.

According to a preferred embodiment, the end cab locomotive comprises at least one switchman's footstep, particularly preferably at least one switchman's stand, at each end of the end cab locomotive, in particular on the right side in each case in the direction of travel of the relevant end cab. For this purpose, the end cab locomotive preferably comprises, as buffers, four extended buffer systems at all four corners. The standard dimensions of switchman's stands means that additional space is required at the four corners of the locomotive. This is preferably provided by the four extended buffer systems. The switchman's footsteps are attached to the locomotive generally on the right in the direction of travel.

It is generally preferred that switchman's footsteps are attached releasably, screwed, or are foldable or rotatable about their longitudinal axis such that, as required, they can also be removed again or folded or rotated into a parking position (and the end cab locomotive can be used again as a main line locomotive).

According to a preferred embodiment, the end cab locomotive, in particular as a spacer, comprises a mounting interface for attaching supporting components to the buffer of a buffer system, said mounting interface comprising a mounting body with a component-fastening region, and an attachment region different therefrom. The component-fastening region is provided here with fastening elements and/or holes for attaching the components. The attachment region is shaped in such a manner that it can be fastened at least one fastening point to a buffer flange with buffer screws.

The mounting body of the mounting interface, which basically also constitutes the mounting interface itself, therefore comprises two different regions, of which one serves for the fastening of the supporting components and the other for attaching the mounting interface to the buffer. The term "supporting components" means components which are attached as intended to one end of a rail vehicle (in the following, the end cab locomotive is also simply referred to as "rail vehicle") and can support a load, in particular ladders, footsteps, handles, stands or mountings.

The component-fastening region is provided for this purpose with fastening elements and/or holes for attaching the 2 relevant supporting components for the rail vehicle. Fastening elements here are preferably bolts or screws which are already fixedly attached to the mounting body. Holes are preferably already provided with a thread, and therefore a component can simply be screwed on the mounting body without necessarily using a nut (with such a nut being able, of course, to be additionally used for securing purposes).

The attachment region is shaped in such a manner that it can be fastened (in particular at least one fastening point, better two, three or four fastening points) to the front side or rear side of a buffer flange with buffer screws (generally commercially available screws), in particular with one, two, three or four screws. For example, it has the same shape as the buffer flange and has, like the buffer flange, holes at the corresponding points such that it can be fastened together with the buffer flange by means of the buffer screws.

According to a preferred embodiment of the mounting interface, the attachment region has the same shape as a predetermined buffer flange or at least part of said buffer flange and can be fastened together with the buffer flange by means of predetermined buffer screws. This has the advantage that simple installation and removal (e.g. for replacement by another mounting interface) is possible. A releasable fastening of the mounting interface, e.g. by means of the buffer screws, is highly advantageous for this purpose.

According to a preferred embodiment of the mounting interface, the attachment region has a recess (e.g. a hole) such that it can encompass a buffer housing (e.g. buffer sleeve or buffer plunger) of a predetermined buffer. A simple attachment of the mounting interface on the buffer plate side to the buffer is therefore possible. The attachment region preferably corresponds here only to part of the surface of a buffer flange of a predetermined buffer and comprises at least two holes for the buffer screws. It preferably has a recess at the location at which a buffer housing is situated on or at the buffer flange.

According to a preferred embodiment of the mounting interface, the attachment region is angled, preferably at a right angle, relative to the component-fastening region. This serves for attaching a footstep, e.g. a horizontal standing surface, e.g. a maintenance stand.

According to a preferred embodiment of the mounting interface, a fastening element is a bolt or a screw and is fixedly attached in the component-fastening region to the mounting body. Alternatively or additionally, a fastening element is a hole in the component-fastening region, which hole is in particular provided with a thread.

A preferred embodiment of the mounting interface comprises, in the component-fastening region, fastening elements or holes designed for attaching further attachments. Said further attachments are preferably a coupler's handle, a switchman's footstep, a switchman's stand, a maintenance stand, a banister and/or a handlebar.

According to a preferred mounting interface, the mounting body is shaped in such a manner that it has at least one (structural) weakening of the mounting body between the component-fastening region and the attachment region. Said weakening is configured here in such a manner that, when a predetermined force acts on the weakening, the component-fastening region is separated from the attachment region. The weakness here is preferably a predetermined breaking point, in particular in the form of a perforation or a shearing element. This has the advantage that components can be separated in a specific manner from one another in the event of an accident. For example, an undisturbed deformation movement of a crash element is intended to be always ensured.

For this purpose, the fastening of supporting components, e.g. handles or footsteps, to the buffer-side side of the crash element is intended to fail in the event of an accident. This is achieved by said weakening which, for example, is a specific weakening of the supporting cross-sectional surface of the mounting body.

The mounting interface therefore makes it possible for a user to connect additional attachments in the front end region in a variable and space-saving manner and nevertheless with sufficient strength.

A preferred embodiment of the buffer system comprises a crash element which is attached to the buffer flange by means of buffer screws. The mounting interface is preferably attached between the crash element and buffer flange. Alternatively, the mounting interface is attached to the buffer flange on the other side of the crash element (i.e. on the buffer plate side).

According to a preferred embodiment of the buffer system, the buffer is a central flange buffer.

According to a preferred embodiment of the buffer system, the attachment region of the mounting interface has the same shape as the buffer flange and like the buffer flange has holes at the corresponding points. The mounting interface is preferably fastened on the buffer flange by means of the buffer screws, in particular between a crash element and the buffer flange. In particular if the buffer is a central flange buffer, the buffer flange has a recess for the passage of the buffer housing.

According to a preferred embodiment of the buffer system, the mounting interface is attached on that side of the buffer flange which is on the buffer plate side, and the attachment region of the mounting interface has a recess, and therefore a buffer housing (e.g. a buffer sleeve or buffer plunger) is at least partially encompassed. The attachment region preferably corresponds only to part of the surface of the buffer flange, and the mounting interface is fastened to the buffer flange with at least two buffer screws.

The switchman's stand or a switchman's footstep for a switchman's stand can be screwed to a standard interface of the end cab locomotive. A particularly advantageous attachment which can securely hold a switchman's footstep with minimal space being required and can additionally take on further functions is presented below. The switchman's footstep is preferably also attached to the attachment part.

According to a preferred embodiment, the end cab locomotive comprises an attachment part with an interface and/or with a mounting element for an accessory component for switching operations (e.g. a tool, a warning element, a footstep, a stand, a banister or a handle), wherein the attachment part is releasably attachable to a vehicle structure of the end cab locomotive in such a way that forces which occur can be transmitted to the rail vehicle structure.

A preferred embodiment of the attachment part comprises an interface designed for the attachment of a footstep, in particular a switchman's footstep, preferably in the lower and/or upper part of the attachment part.

A preferred embodiment of the attachment part comprises an interface designed for the attachment of a stand, preferably a switchman's stand, in particular according to the standard EN16116-1, wherein the interface is arranged in this regard preferably in the lower region of the attachment part. Alternatively or additionally, such a stand is preferably a maintenance stand, wherein the interface is arranged in this regard preferably in the upper region of the attachment part.

A preferred embodiment of the attachment part comprises a mounting element designed for storing a tool (a warning element is also understood here as meaning a tool), preferably for the mounting of a drag shoe or a signal, e.g. a final signal. The mounting element can be in particular a pocket or tab into which a tool can be inserted. It can also be a hook, but a pocket is preferred since a tool may swing to and fro on a hook. Basically, mounting elements of this type which serve for holding tools are known per se. In the preferred application, it is preferred for a mounting element to additionally have a fixing element, e.g. a split pin or a closable tab which serves for fixing a tool in the mounting element so that the tool cannot fall out when a bump is travelled over.

A preferred embodiment of the attachment part comprises an interface designed for the attachment of a grip and/or a bar, preferably a handle and/or a holding bar and/or a footstep bar, in particular a hand bar for a switchman's stand. This interface can also be identical to one of the previously mentioned interfaces. It is highly advantageous to configure an interface in such a manner that different accessory components can be attached there.

A preferred embodiment of the attachment part comprises a fastening region which is configured in such a manner that it is attachable to a standard interface of a rail vehicle, in particular a rail vehicle with an end cab, preferably to a lateral standard interface. As is noted, the standard interface is not an interface of the attachment part, but rather is part of the rail vehicle. The standard interfaces of a rail vehicle are known and are, for example, an arrangement of holes which are provided with a thread. The fastening region then preferably comprises an identical arrangement of holes, and therefore the fastening region can be screwed to the relevant standard interface.

A preferred embodiment of the attachment part is shaped as a plate at least in the region of its fastening as intended to the rail vehicle (in the fastening region). This has the advantage that the attachment part lies flat against the rail vehicle, in particular when attached laterally. Furthermore, the attachment part is preferably shaped in such a manner that, when attached as intended to a rail vehicle, its contour does not project beyond the outer side wall of the rail vehicle by more than 200 mm. This is advantageous for the aerodynamics, the acoustics and the operational safety since any element projecting beyond the contour of a rail vehicle constitutes a potential risk. Furthermore, it serves to keep predetermined clearance gauges free.

A preferred embodiment of the attachment part has, at the rear, a fastening region for fastening as intended to the rail vehicle and, at the front, at least one interface for the fastening of a footstep or a stand. In between, the attachment part preferably has a mounting element designed for storing a tool.

A preferred embodiment of the rail vehicle comprises an end cab, wherein the attachment part is attached in the region next to and/or in front of the end cab, and preferably is releasably fastened in the side region of the rail vehicle. The buffers of the rail vehicle are preferably attached here in such a manner that a switchman's stand according to a current standard, e.g. the standard EN16116-1, can be attached between the end cab and the buffer plate. A preferred end cab locomotive for switching operations comprises buffer systems, an end cab and a switchman's footstep in front of the end cab on the side of a first buffer system. The switchman's footstep is arranged here in such a manner that, when the buffer is completely elastically pushed in, the buffer plane lies in front of the switchman's footstep. The space above the switchman's footstep, i.e. the space which is spanned by the vertical projection of the switchman's footstep, therefore lies outside the clearance of the first buffer system. The attachment part is preferably configured and positioned in such a manner that this switchman's footstep can be attached to the attachment part and held by the latter on the end cab locomotive.

According to a preferred embodiment of the rail vehicle, the attachment part is attached to a standard interface of the rail vehicle. This is preferably a standard interface in the end region of the rail vehicle, in particular in the region of an end cab. A lateral standard interface of the rail vehicle is particularly preferred here since a comparatively large amount of force is transmitted there to the rail vehicle structure.

According to a preferred embodiment of the rail vehicle, the attachment part is screwed to the rail vehicle. As already indicated above, it preferably does not project by more than 200 mm beyond the side contour of the rail vehicle, and in particular the required clearance gauge is therefore kept free and a risk of injury is minimized.

According to a preferred embodiment of the rail vehicle, a stand, in particular a switchman's stand, a step, a banister and/or a holding bar is attached, preferably releasably, to the attachment part, in particular by means of a screw connection.

The banister or the hand bar for a switchman's stand can be a normal banister or a normal hand bar. A particularly advantageous banister which can take on a plurality of functions while taking up minimal space is presented below.

According to a preferred embodiment, the end cab locomotive comprises a banister arrangement with a banister element and with a holding element in which the banister element is arranged (mounted) so as to be rotatable about an axis of rotation, wherein the holding element is arranged in the external region of the end cab locomotive in such a manner that the axis of rotation is oriented vertically. The banister arrangement or a footstep delimited by the banister arrangement preferably comprises a number of locking elements which are configured and arranged in such a manner that they can releasably fix a banister element of the banister arrangement in a predetermined position, in particular in such a manner that the banister element can be fixed in two different positions. These two positions preferably have with respect to each other an angle of rotation of at least 70° about the axis of rotation, particularly preferably of at least 80°, in particular of 90°, about the axis of rotation.

A banister arrangement may also be referred to as a "handlebar arrangement" or "footstep bar arrangement", depending on the designated position on a rail vehicle. For example, a banister arrangement arranged at a low level can also serve as a footstep and one arranged at a high level as a grip. However, a banister arrangement can also serve both as a grip and as a footstep, e.g. as a footstep rung, if the banister arrangement serves as a type of ladder.

The banister arrangement is therefore attached rotatably to the rail vehicle and can therefore be pivoted into different positions. Preferred positions are a position for switching purposes ("switching position") and a position for maintenance purposes ("maintenance position").

In the switching position, the banister arrangement is intended to be situated in such a manner that it provides a gripping option for holding during the switching operation, in particular when remote using a control. It would furthermore be advantageous if, in the event of a switchman's footstep being present in the front end region, said switchman's footstep is correspondingly delimited on one side by a banister element of the banister arrangement. In addition, in the switching position, the banister arrangement is intended to block access to an upper footstep plane for working protection reasons. Such access is not necessary in switching operations. The banister arrangement is intended to be oriented in the switching position in such a manner that it provides securing from the front toward the buffer and an additional possibility for taking up the secure switching position. For this purpose, it does not have to be located in front of the switchman's footstep (on the side facing away from the rail vehicle), but better delimit the side which faces a buffer (next to the switchman's footstep) since a path to an upper footstep plane arranged above the buffer can thereby be effectively blocked.

In addition, a clearance is intended to be ensured above the switchman's footstep in accordance with the standard, i.e. the space is not obstructed by footstep steps to an upper footstep plane. An embodiment which achieves this will be described further below.

For maintenance purposes, the banister arrangement is intended to be able to be rotated from the switching position into the maintenance position (and optionally fixed), as a result of which the path to the upper footstep becomes free. At the same time, the banister arrangement is intended to provide a gripping possibility when climbing up and climbing down and a safety barrier forward to the buffer for working 22 protection reasons. For this purpose, a banister element is preferably rotated in such a manner that it is now located in front of the upper footstep (on the side facing away from the rail vehicle). It would also be desirable if, in the maintenance position, the banister arrangement were to provide additional footstep steps to safely reach the upper step, in a manner meeting the needs of working protection, in the clearance of the switchman's step. Such an embodiment will be described further below.

According to a preferred embodiment of the banister arrangement, the banister element comprises bars which are arranged parallel and/or orthogonally to the axis of rotation. The bars are intended to have a diameter of greater than 2 cm, but smaller than 10 cm, so that they can readily be grasped and so that they can be used as comfortable footsteps. It is preferred here if at least some of the bars arranged in parallel are designed as handlebars and/or at least some of the orthogonally arranged bars are designed as footstep bars. It should be noted that, in the event of rotation about the vertical axis of rotation, the orientation of the bars (parallel or orthogonally) to said axis of rotation does not change and the bars can continue to be used as a grip or footstep, or simply just for blocking. The bars are preferably hollow.

A preferred embodiment of the banister arrangement comprises at least two banister elements on opposite sides of the holding element, preferably one above the holding element (with respect to the axis of rotation) and one below the holding element. The banister elements are preferably fixedly connected to one another by a rigid bar and are jointly rotatable about the axis of rotation. Alternatively, they can also be unconnected and rotatable independently of one another about the axis of rotation.

It is preferred that the banister elements are preferably rotated or rotatable by 90° with respect to one another about the axis of rotation, i.e. they are orthogonal or can be oriented orthogonally to one another. Therefore, in the connected case, it is possible, for example, for an (upper) banister element to secure a switchman's footstep to the side (toward a buffer) and to serve as a grip and for a (lower) banister element to secure the switchman's footstep forward. The term "to the side" means that the plane of a banister element is oriented vertically and parallel to the longitudinal axis of the rail vehicle, and the term "forward" means that the plane of a banister element is oriented vertically and orthogonally to the longitudinal axis of the rail vehicle.

According to a preferred embodiment of banister arrangement, at least one banister element is lockable or fixable. For this purpose, it preferably has a locking element in the region of the axis of rotation or remote from the axis of rotation. The banister element can therefore be fixed in preferred positions, e.g. in the abovementioned switching position and/or the maintenance position, and therefore an unintentional rotational movement is prevented. This serves for secure holding or for ensuring a safety feature. The locking element does not necessarily have to be part of the banister arrangement. It suffices if the banister arrangement is formed at predetermined points in such a manner that it can engage in a locking element or can be held by the latter. For example, in a very simple case, a banister element can have at the bottom a vertical tube end which can engage in a hole in a plate on the rail vehicle.

According to a preferred embodiment, the banister arrangement is a steel tube structure or a plastics tube structure. The tubes can be hollow or compact (i.e. bars made of solid material). However, hollow elements are preferred since they have a lower weight while having sufficient strength.

A preferred embodiment of the rail vehicle comprises an end cab, wherein the banister arrangement is attached in the region next to or in front of the end cab, preferably in the region of buffers of the rail vehicle. Said buffers are preferably attached in such a manner that a switchman's stand according to a current standard, e.g. the standard EN16116-1, can be attached between the end cab and the buffer plate. A preferred end cab locomotive for switching operations comprises buffer systems, an end cab and a switchman's footstep in front of the end cab on the side of a first buffer system. The switchman's footstep is arranged here in such a manner that, when the buffer is completely elastically pushed in, the buffer plane lies in front of the switchman's footstep. The space above the switchman's footstep, i.e. the space which is spanned by the vertical projection of the switchman's footstep, therefore lies outside the clearance of the first buffer system. The banister arrangement is preferably arranged on this rail vehicle in such a manner that, when the buffer is completely elastically pushed in, the buffer plane lies in front of the banister arrangement. The banister arrangement therefore preferably lies outside the clearance of the buffers of the rail vehicle.

According to a preferred embodiment of the rail vehicle, the (or a) banister element comprises bars which are arranged parallel and/or orthogonally to the axis of rotation (see above). It is preferred here that at least some of the bars which are arranged parallel to the axis of rotation and are arranged above a buffer of the rail vehicle are designed as handlebars. It is similarly preferred for at least some of the bars which are arranged orthogonally with respect to the axis of rotation and are arranged under a buffer of the rail vehicle are designed as footstep bars. When a person is standing on a switchman's footstep, this region is located below the buffer in the region of the person's leg, and therefore a footstep is advantageous there if the person wants to climb to a higher level. A banister above the buffers is located in the region of the person's arm, and therefore a grip is advantageous there.

A preferred embodiment of the rail vehicle comprises a number of blocking elements which are configured and arranged in such a manner that they can releasably fix a banister element of the banister arrangement in a predetermined position. The locking elements do not absolutely have to be located on the banister arrangement; instead, they can be arranged in particular on a footstep. In a simple case, they can be holes in a footstep plate, into which a tube end of a banister element can be introduced. Preferably, a number of locking elements are arranged in such a manner that they can fix a part of the banister element that is remote from the axis of rotation. This increases the lever effect of the locking elements.

A preferred embodiment of the rail vehicle is configured with a number of locking elements to such an extent that a (the) banister element can be fixed in two different positions. These positions preferably correspond to an angle of rotation of at least 70° about the axis of rotation, particularly preferably of at least 80°. Preferred positions lie rotated with respect to one another about the axis of rotation in particular by an angle of rotation of 90°.

A preferred embodiment of the rail vehicle additionally comprises a footstep (e.g. for maintenance or switching purposes) which is arranged in particular in the region of a buffer of the rail vehicle.

For example, a switchman's footstep can be arranged offset somewhat laterally under the buffer, or a maintenance footstep can be arranged on or above the buffer or a crash element on the buffer. Said footstep is intended to be delimited on at least one side by a banister element of the banister arrangement (and therefore in particular to form a stand). The rail vehicle preferably comprises at least two footsteps in the region of the buffer, e.g. the abovementioned switchman's footstep and maintenance footstep which are jointly delimited on at least one of their sides by at least one banister element of the banister arrangement. The delimitation by the banister element is preferably such that it forms a barrier in a position of the banister arrangement between the two footsteps and lies in particular on a vertically oriented plane which, in the case of blocking, is preferably oriented parallel to the longitudinal axis of the rail vehicle.

A preferred embodiment of the rail vehicle comprises an upper footstep (maintenance footstep) above a buffer of the rail vehicle (e.g. on or above the buffer or a crash element of the buffer) and a lower footstep (switchman's footstep) below the buffer (and somewhat laterally offset), which footsteps are jointly delimited on at least one side by at least one (upper) banister element of the banister arrangement. Said banister element preferably reaches at least 70 cm, in particular at least 90 cm or even one meter above the upper footstep, and therefore it can be used as a banister and/or handle for both footsteps.

It is preferred here that the banister element can be rotated about the axis of rotation into a first position (the maintenance position) in which it permits access from the lower footstep to the upper footstep and, as a banister, preferably additionally delimits the upper footstep on its side facing away from the rail vehicle. Furthermore, it is preferred that the banister element can be rotated about the axis of rotation into a second position (the switching position) in which it blocks access from the lower footstep to the upper one and preferably can additionally be used as a grip for a person standing on the lower footstep.

A preferred embodiment of the rail vehicle comprises a (lower) banister element which is arranged in the height region between the aforementioned footsteps and can be used as a banister and also as a step or ladder. It is preferred here for said banister element to be able to be rotated about the axis of rotation into a first position (maintenance position) in which it can serve as a step/ladder from the lower footstep to the upper footstep and, as a banister, preferably additionally delimits the lower footstep from the buffers of the rail vehicle, and can be rotated into a second position (switching position) in which, as a banister, it delimits the lower footstep on its side facing away from the rail vehicle. The (lower) banister element mentioned here is particularly advantageous in combination with the aforementioned (upper) banister element. In particular if the two banister elements lie on respective planes which are rotated 90° with respect to one another about the axis of rotation. If the (upper) banister element is oriented parallel to the longitudinal axis of the rail vehicle, the (lower) banister element is preferably orthogonal thereto, and vice versa.

A preferred embodiment of the rail vehicle additionally comprises a mounting interface for attaching the banister arrangement to a buffer of the rail vehicle, said mounting interface comprising a mounting body with a component-fastening region and an attachment region different therefrom, wherein the component-fastening region is provided with fastening elements and/or holes for attaching the components, and the attachment region is shaped in such a manner that it can be fastened at least two fastening points of a buffer flange of the buffer (also sometimes referred to as a "buffer baseplate") with buffer screws (as a rule commercially available screws). The space available is thereby optimally used and therefore the standardized requirements for switching met.

The coupling can be a coupling according to the prior art, e.g. a screw coupling or a Keller's coupling. However, it can also be a switching coupling. In the case of a switching coupling, the end cab locomotive preferably comprises a particular catch device comprising a catch body with an end stop, a right side stop and a left side stop, which together form a holding body. Said body has an internal region delimited on three sides (by the stops) and an open side which, however, can be locked with a lock. Said open side is dimensioned in such a manner that the switching coupling of the end cab locomotive can be moved through the open side into the internal region. Such a catch device has been known to date from the prior art. The catch device has preferably a, in particular polygonal, U profile.

When said catch device is arranged on the end cab locomotive, the end stop is located on the locomotive-side part of the internal region. When a switching coupling is received by the catch device and pushed into its parking position, the lock of the open side has been open and is subsequently closed to prevent the switching coupling from falling out of the parking position. Of course, the open side has to be of such a size that said switching coupling passes through it in order to be received at all by the catch device. Although the switching coupling is not part of the catch device, it serves as a measure for the dimensioning thereof.

The preferred catch device has at least one elastic and/or elastically mounted stop element on one of the stops (i.e. on the end stop and/or on at least one of the side stops). By means of said stop elements, a switching coupling introduced into the interior has a significantly reduced play in comparison to previous catch devices. A movement of a switching coupling in the catch device can therefore be reduced to a minimum. The passage "elastic and/or elastically mounted stop element" means that the stop element itself can be elastic, the stop element can be inelastic but is then mounted elastically, or the stop element can be elastic and additionally mounted elastically.

In a preferred catch device, at least one stop element comprises an elastic buffer element. Said buffer element has a modulus of elasticity greater than 0.05 GPa and smaller than 10 GPa. The modulus of elasticity thereof is preferably smaller than 6 GPa and/or greater than 0.1 GPa.

Preferred materials from which a buffer element can be manufactured are elastomers, e.g. rubber or silicone (individually or in combination); however, use may also be made of springs made from steel or plastic, e.g. spiral springs or leaf springs.

According to a preferred embodiment of the catch device, at least one stop element, preferably at least of the end stop, is mounted elastically by means of a spring or an elastic buffer element (as previously described). Said mounting is preferably configured in such a manner that a switching coupling located in the internal region of the catch device can be (at least partially) pushed out of the internal region through the open side. If the catch device is attached to a rail vehicle, the relevant stop element is preferably configured in such a manner (and the catch device attached in such a manner) that a switching coupling can be pushed out of a parking position by the spring-mounted stop element into an angle of inclination of less than 87° with respect to the horizontal, in particular less than 85°, or even less than 80°, with respect to the horizontal.

According to a preferred embodiment of the catch device, a movement of the elastically mounted stop element in the direction of the spring force of the spring or the elastic buffer element is guided by means of a guide element. This has the advantage that tilting of the stop element, and therefore blocking of the movement, is prevented. At least one of the guide elements is preferably arranged next to the spring or the elastic buffer element. Alternatively or additionally, at least one of the guide elements is surrounded by a spring. Therefore, for example, sprung bolts can ensure guidance and at the same time elastic mounting of the stop element. However, reliable guidance can also be achieved by guide elements which are present independently of the sprung mounting.

According to a preferred embodiment of the catch device, both the right side stop and the left side stop each have an elastic stop element. The stop elements preferably lie opposite one another on a line, which has the advantage that an oblique moment of force does not act on a switching coupling by means of the stop elements. The stop elements are particularly preferably arranged in such a manner that they hold a switching coupling in a form-fitting manner to the right and left. The switching coupling therefore is not intended to have any play to the right and left, but rather is intended to be held fixedly between the stop elements. However, slipping to the rear and front (toward the end stop or away from the latter) is preferably intended to be possible since in this way an above-described elastically mounted stop element can (at least partially) push the coupling out of the catch device.

According to a preferred embodiment, the catch device comprises a lock which is shaped in such a manner that it can close the open side of the catch body, the lock preferably comprising a bolt and/or a chain. A combination of a bolt and chain is preferred since this ensures a particularly reliable lock. Particularly preferably, the lock has an (in particular elastic) element for protecting other elements of the lock and of the switching coupling. In particular, the bolt is surrounded by an elastic protective layer or at least one protective layer made from plastic. This protects the bolt against movements of the switching coupling during movement of a rail vehicle, and of course also the switching coupling.

According to a preferred embodiment of the catch device, a part of a stop element that faces away from the respective stop has a spherical shape, i.e., for example, the shape of a hemisphere. A stop element preferably has the shape of a hemisphere placed onto a cylindrical base. However, a stop element can also simply have the shape of an elastic plate.

According to a preferred embodiment of the catch device, at least one stop element is screwed to the catch device. A screw is preferably arranged here centrally in the stop element. Alternatively, however, a plurality of screws can also be arranged mirror-symmetrically with respect to a central plane or rotationally symmetrically with respect to the center point of the stop element.

According to a preferred embodiment of the catch device, an elastically mounted stop element is arranged on the end stop, the sprung movement of which stop element is preferably guided by means of guide elements. On its side facing the internal region, the stop element preferably also has an (elastic) buffer element. The stop element is elastically mounted on the end stop in such a manner that it can push a predetermined switching coupling out of a parking position if a lock of the catch device is opened. The rear stop for a switching coupling (end stop) is therefore designed to be elastically movable, as already described above. The switching coupling is pivoted into the parking position counter to said spring-loaded stop. During the lowering, the spring force of the stop element causes the switching coupling to be reliably pushed out of the parking position.

The invention will be explained once again in detail below with reference to the attached figures and using exemplary embodiments. The same components in the various figures are provided with identical reference numbers. The figures are generally not to scale. In the figures:

DETAILED DESCRIPTION OF THE INVENTION

Figure 1:
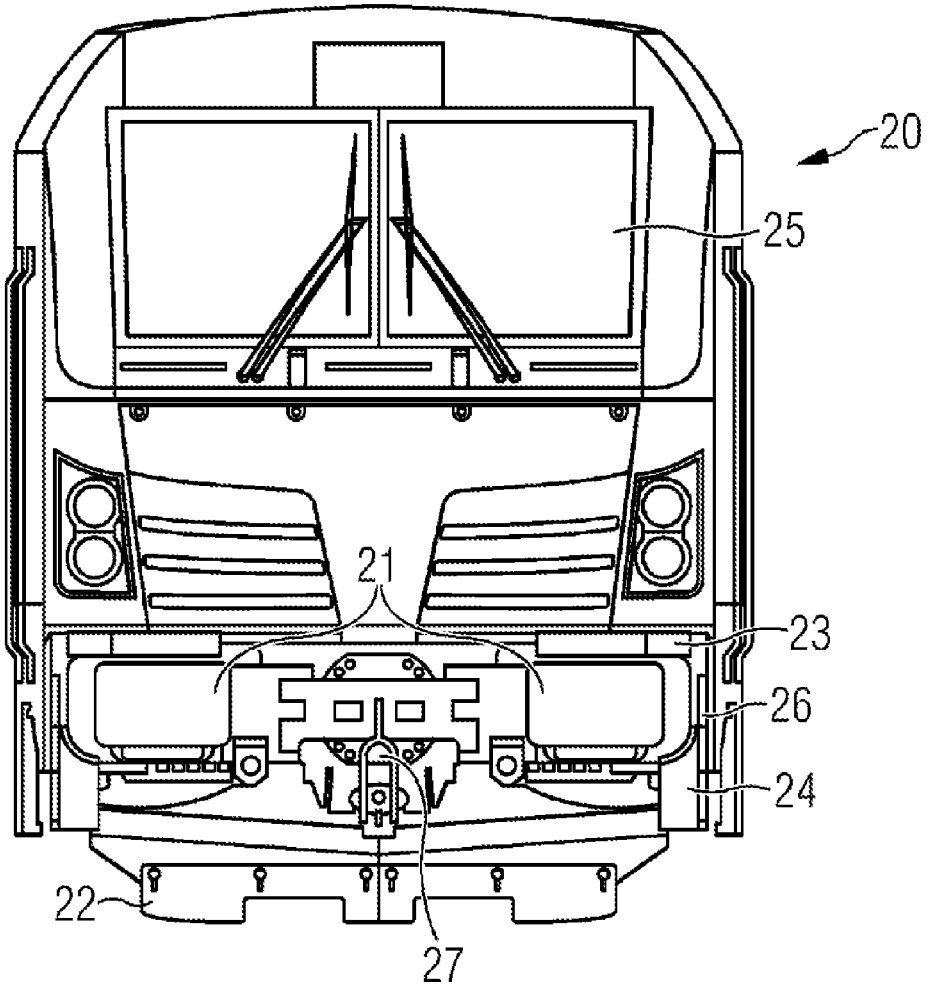
FIG 1 Prior art
FIG. 1 shows a rail vehicle according to the prior art.
Figure 1:
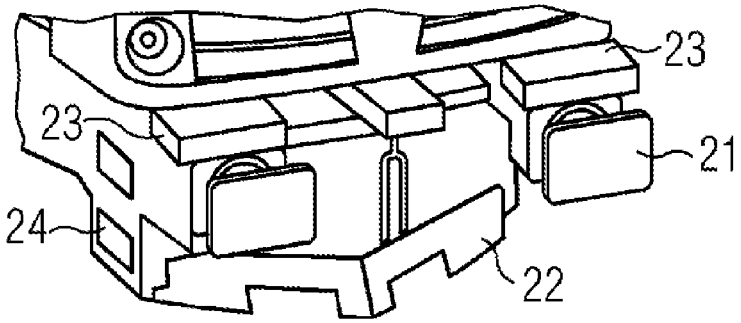
FIG 1 Prior art

FIG. 1 shows a rail vehicle 20 with an end cab 25 according to the prior art from the front and the buffer region thereof additionally is also in a perspective view for better clarity. This is a typical design of the front end region of a rail vehicle 20 with an end cab 25. The buffers 21, the coupling 27 and the front apron 22 can clearly be seen. An upper footstep plane 23 which can be reached via footsteps 24 on the side of the rail vehicle 20 is arranged on the buffers 21 for maintenance purposes. The footsteps 24 are screwed to the side of the rail vehicle 20 at a standard interface. Due to the restricted space provided, there is no space here for a switchman's footstep according to standard EN16116, but merely for the footsteps and the footstep plane (neither of which are a switchman's footstep according to the standard EN16116).

Figure 2:
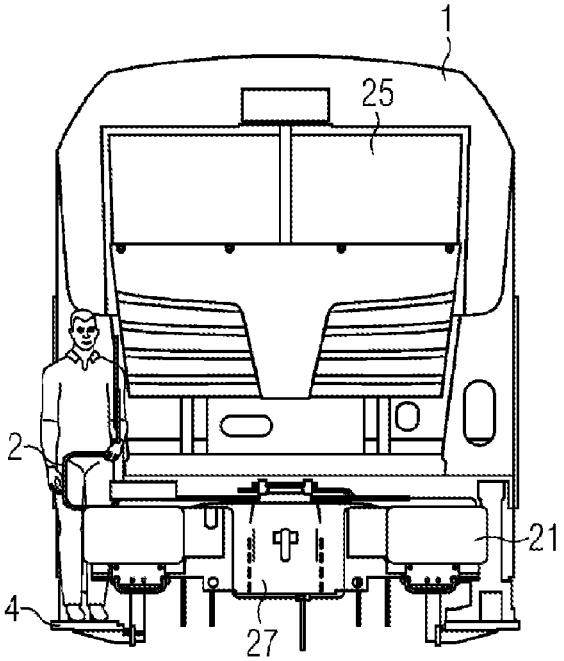
FIG. 2 shows an exemplary embodiment of an end cab locomotive according to the invention from the front.
Figure 3:
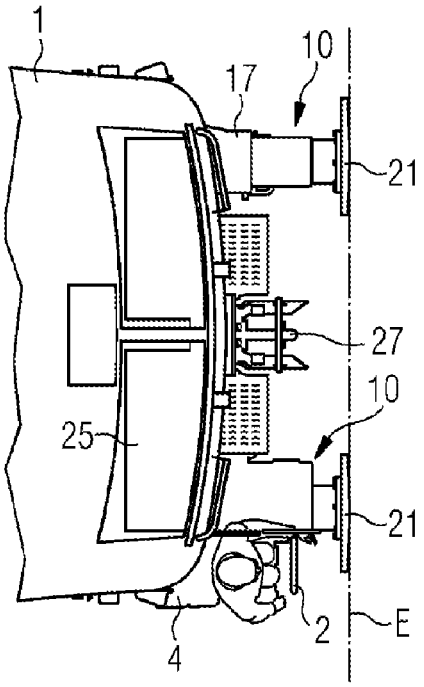
FIG. 3 shows an exemplary embodiment of an end cab locomotive according to the invention from above.

FIG. 2 shows an exemplary embodiment of an end cab locomotive 1 according to the invention, and FIG. 3 shows the exemplary embodiment from FIG. 2 once again from above. It basically shows a rail vehicle 20 with an end cab 25 according to FIG. 1, but which has been modified in accordance with the invention. The end cab locomotive 1 which is shown is now suitable for switching operations and is provided with a switchman's stand 2, 4 (switchman's footstep 4 and banister arrangement 2). In order to create the required space for the switchman's stand 2, 4, the end cab locomotive 1 comprises two special buffer systems 10 (see, e.g., FIG. 7) which are arranged on the right and left of the coupling 27. Each of the buffer systems 10 is extended by means of a spacer 17, and therefore the switchman's footstep is still at a sufficient distance from the buffer plate 21, e.g. is at least 300 mm away from the latter. The buffer plane E of the buffer, which is relaxed here, is indicated by chain-dotted lines.

Figure 4:
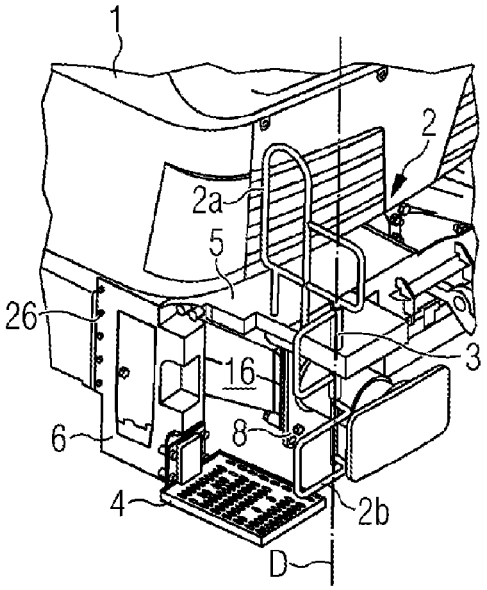
FIG. 4 shows a preferred end cab locomotive with a switchman's stand.

FIG. 4 shows an end cab locomotive 1 with a preferred switchman's stand 2, 4, comprising a switchman's footstep 4 and a preferred banister arrangement 2 in the switching position. Part of the perspective detail from FIG. 1 can be seen from a somewhat different viewing angle. A preferred banister arrangement 2 is illustrated with an upper banister element 2*a* and a lower banister element 2*b* which are both mounted lying opposite one another in a rotatable manner in a holding element 3 (one above the holding element 3 and one below) such that they can rotate about a vertical axis of rotation D (chain-dotted line). In this example, for better understanding of the orientations, described below, of the banister elements 2*a*, 2*b*, it can be assumed that the upper banister element 2*a* is fixedly connected to the lower banister element 2*b* via a continuous bar, and therefore, when the upper banister element 2*a* rotates, the lower banister element 2*b* correspondingly rotates therewith.

In the front end region, the end cab locomotive 1 has a maintenance footstep at the top and a switchman's footstep 4, which is mounted on an attachment part 6 (see FIG. 6), at the bottom. On the maintenance footstep 5 it is possible, for example, to reach the window of the end cab 25 in order to clean it. A person can stand on the switchman's footstep 4 during switching operations. It corresponds here to the specifications of the standard EN16116.

Figure 7:
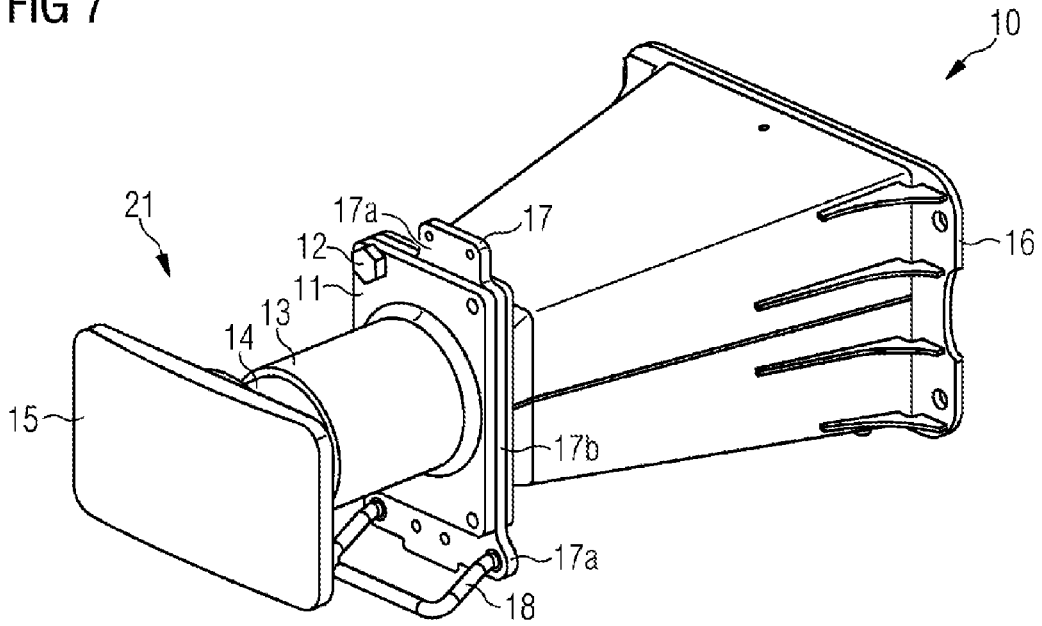
FIG. 7 shows a preferred buffer system for an end cab locomotive according to the invention.

In this example, the maintenance footstep 5 is attached directly to the buffer 21 by means of a mounting interface (see FIG. 7). The mounting interface 17 is located here between the buffer flange 11 of the buffer 21 and a crash element 16 and is fastened there with the buffer screws 12.

The banister elements 2*a*, 2*b* of the banister arrangement 2 are manufactured here from bars (rods) which are preferably hollow and are preferably a steel tube structure. In the upper banister element 2*a*, the bars largely run parallel to the axis of rotation D so that they can readily serve as gripping bars. In the lower banister element 2*b*, the bars largely run orthogonally to the axis of rotation D so that they can readily serve as footstep bars.

The banister arrangement 2 is positioned in such a manner that it delimits the two footsteps 4, 5 on at least one of the sides thereof with a banister element 2*a*, 2*b*. The banister arrangement 2 can be rotated into a switching position (FIG. 4) and into a maintenance position (FIG. 5) and fixed there.

FIG. 4 shows the banister arrangement 2 in the switching position. In this position, access from the switchman's footstep 4 to the maintenance footstep 5 is blocked by the upper banister element 2*a* which can additionally be used as a grip for a person standing on the switchman's footstep 4. The lower banister element 2*b*, which is arranged between the footsteps 4, 5, is used here as a banister and delimits the switchman's footstep 4 on its side facing away from the end cab 25.

Figure 5:
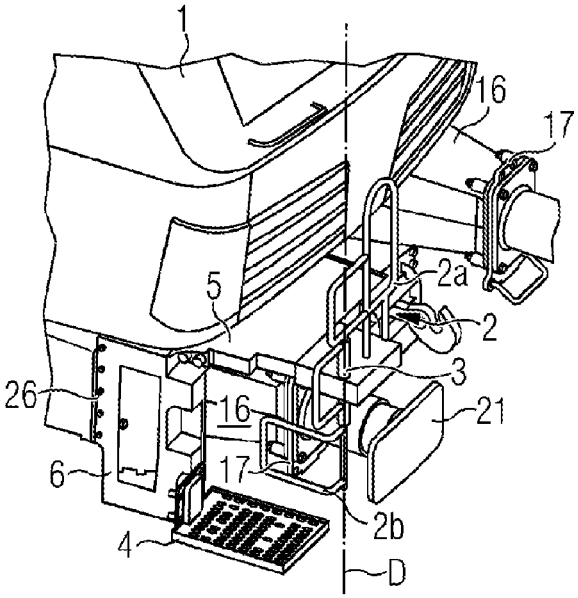
FIG. 5 shows a preferred end cab locomotive with a maintenance stand.

FIG. 5 corresponds to FIG. 4 with the difference that the banister arrangement 2 is rotated there into the maintenance position. In the maintenance position, access from the switchman's footstep 4 to the maintenance footstep 5 is permitted since the upper banister element 2*b* has now been pivoted forward and forwardly delimits the front side of the maintenance footstep 5. Therefore, at the same time, the transition between the switchman's footstep 4 to the maintenance footstep 5 is free, and the lower banister element 2*b* can serve as a footstep from the switchman's footstep 4 to the maintenance footstep 5 and, as a banister, additionally delimits the switchman's footstep 4 from the buffers 21 of the end cab locomotive 1.

Figure 6:
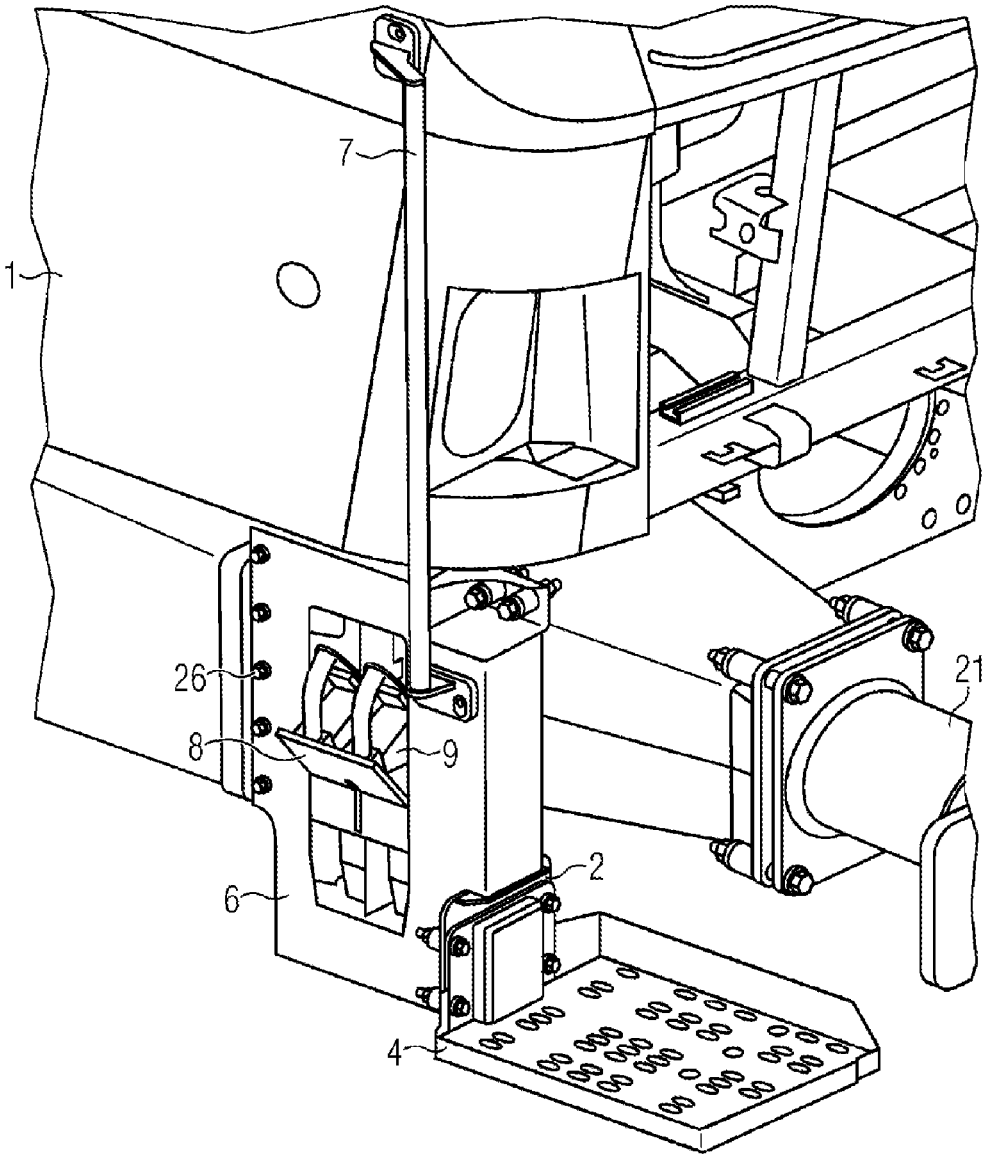
FIG. 6 shows a preferred end cab locomotive with an attached switchman's footstep.

FIG. 6 shows a preferred end cab locomotive 1 with an attached switchman's footstep 4 which is fastened to a special advantageous attachment part 6. The attachment part 6 is attached to a lateral standard interface 26 in the region of the end cab 25 (see, e.g., FIG. 1); this is the standard interface 26 to which the footsteps 24 are attached there). The attachment part 6 comprises a fastening region at the rear for fastening it as intended to a lateral standard interface 26 of the end cab locomotive 1 and at the front three interfaces for fastening the switchman's footstep 4 at the bottom, a maintenance stand 5 at the top (not shown here, see, e.g., FIGS. 4 and 5) and a handle 7 likewise at the top. Between the interfaces and the fastening region, the attachment part has two mounting elements 8 which serve for storing drag shoes 9.

The attachment part 6 is releasably fastened via the standard interface 26 to a rail vehicle structure of the end cab locomotive 1 by means of screws, and therefore forces which occur, e.g. because of the weight of the drag shoes 9 or that of a person standing on the switchman's footstep 4 (see, e.g., FIGS. 2 and 3) can be transmitted to the rail vehicle structure.

The attachment part 6 is formed here as a plate in the region of its fastening as intended to the end cab locomotive 1 and has an indentation in the region of the mounting elements 8 such that the drag shoes 9 do not project by more than 200 mm beyond an outer side wall of the end cab locomotive 1. The front part is somewhat thickened and has approximately the cross section of a square. This serves for better stability. Despite its thickened portion, this region does not protrude laterally beyond the side wall of the end cab locomotive 1, but rather into the space at the buffers 21.

FIG. 7 shows a preferred buffer system 10 for an end cab locomotive 1 according to the invention with an exemplary embodiment of a mounting interface 17 according to the invention to which a footstep 18 is attached.

The buffer system 10 comprises a buffer 21 with a buffer flange 11 which serves for fastening the buffer 10 to a buffer beam of a rail vehicle 20 or, as illustrated here, to a crash element 16. The buffer is fastened by means of buffer screws 12, of which only a single one is illustrated here, in order also to show the holes which are present for this purpose in the buffer flange 11 and the crash element 16. The buffer sleeve 13, into which the buffer plunger 14 projects, is welded here onto the buffer flange 11. Both elements are part of the buffer housing. Between said two elements, an elastic buffer element which is not visible here is introduced into the interior of the buffer housing, said buffer element being able to reversibly absorb and dispense pressures which act on the buffer plate 15, wherein it can preferably also somewhat convert the energy into heat and therefore serves as an impact damper. In the event of an accident in which much higher forces are in action than normally, the crash element 16 serves to absorb said forces. It is deformed irreversibly in the process and acts as a crumple zone.

The buffer system 10 according to the invention comprises, between the buffer 21 and the crash element 16, a mounting interface 17 which is attached to the buffer flange 11 and to the crash element 16 with buffer screws 12. Said mounting interface here has a mounting body 17 (and consists in this example basically of said mounting body 17) which here comprises two component-fastening regions 17*a* which are separated from each other, an upper and a lower component-fastening region, to which the footstep 18 is also attached. Between said component-fastening regions 17*a* there is the attachment region 17*b* which here has the same shape as the buffer flange 11. The component-fastening region 17*a* is provided here with holes, but it could be entirely possible for there also to be screws instead of the holes in the component-fastening region 17*a*. The attachment region 17*b* can be fastened here between the crash element 16 and buffer flange 11 with all four buffer screws 12, and therefore said buffer screws 12 connect the crash element 16 and buffer flange 11 by the mounting interface 17 lying in between to the buffer system 10 which additionally uses the mounting interface 17 as a spacer 17.

Figure 8:
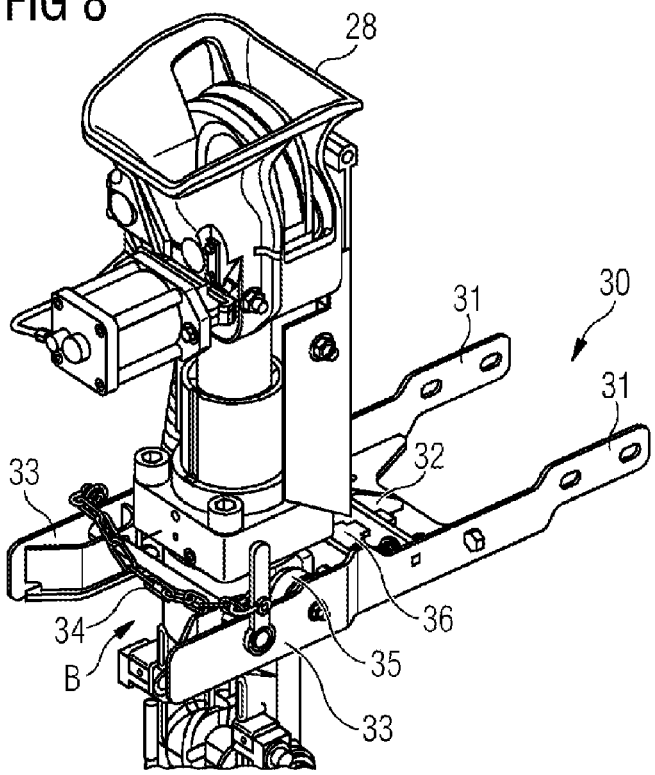
FIG. 8 shows a switching coupling with a preferred catch device.

FIG. 8 shows a switching coupling 28 in a parking position in a preferred catch device 30. The catch device 30 comprises a catch body, which can be fastened with a fastening 31 to the end cab locomotive 1, an end stop 32, a right side stop and a left side stop 33, which together form a holding body which has an internal region B delimited on three sides. Said body furthermore has an open side, but which is lockable to a lock 34 and is dimensioned in such a manner that the switching coupling 28 can be moved through the open side into the internal region B. The catch device 30 in each case has an elastic stop element 35 at the two side stops 33 and an elastically mounted stop element 36 at the end stop 32.

In conclusion, attention is once again drawn to the fact that the embodiments described in detail above are merely exemplary embodiments which can be modified in many different ways by a person skilled in the art without exceeding the scope of the invention. Moreover, the use of the indefinite article "a" or "an" does not exclude the possibility that there may be more than one of the features concerned. In addition, terms such as "unit" do not exclude the fact that the components concerned consist of a plurality of interacting subcomponents which may optionally also be arranged in a spatially distributed manner.

The invention claimed is:

1. An end cab locomotive for switching operations, the end cab locomotive comprising:

buffer systems including a first buffer system having a buffer with a buffer plane;

an end cab;

a switchman's footstep disposed in front of said end cab on a side of said end cab having said first buffer system;

said switchman's footstep being disposed to locate said buffer plane of said buffer of said first buffer system in front of said switchman's footstep upon said buffer being completely elastically pushed in;

a buffer flange having fastening points;

buffer screws;

a mounting interface for attaching supporting components to said buffer of said first buffer system;

said mounting interface including a mounting body with a component-fastening region and an attachment region different from said component-fastening region;

said component-fastening region being provided with at least one of fastening elements or holes for attaching the components; and said attachment region being configured to be fastened at least at two of said fastening points of said buffer flange with said buffer screws.

2. The end cab locomotive according to claim 1, wherein said switchman's footstep has a front edge, and said first buffer system is extended to cause said front edge to be at least 150 mm away from said buffer plane of said first buffer system in a relaxed state of said first buffer system.

3. The end cab locomotive according to claim 2, wherein:

said buffer systems include a second buffer system disposed on said end cab and being extended to cause said front edge to be at least 150 mm away from a buffer plane of said second buffer system in a relaxed state of said second buffer system;

said switchman's footstep is part of a switchman's stand having said front edge; and said switchman's footstep has a length of at least 350 mm.

4. The end cab locomotive according to claim 1, wherein:

said first buffer system has a buffer plate and a buffer flange with a side facing away from said buffer plate; and said first buffer system has at least one of:

a spacer on said side of said buffer flange facing away from said buffer plate, or an extension in a longitudinal direction between said buffer flange and said buffer plate.

5. The end cab locomotive according to claim 1, wherein said first buffer system includes at least one of:

a crash element or a crash element and a buffer housing partially projecting into said crash element.

6. The end cab locomotive according to claim 5, wherein said first buffer system includes a buffer screw-on surface and a spacer disposed between said crash element and said buffer screw-on surface, and said buffer housing is a central flange buffer.

7. The end cab locomotive according to claim 1, wherein said mounting interface is a spacer.

8. The end cab locomotive according to claim 1, which further comprises:

a vehicle structure of the end cab locomotive; and an attachment part having at least one of an interface or a mounting element for an accessory component for the switching operations;

said attachment part being releasably attachable to said vehicle structure for transmitting occurring forces to said vehicle structure.

9. The end cab locomotive according to claim 8, wherein said switchman's footstep is attached to said attachment part.

10. A buffer system for the end cab locomotive according to claim 1, the buffer system comprising:

said buffer with a buffer plate, said buffer flange and said buffer plane;

said buffer plane being spaced apart from said switchman's footstep with a clearance of at least 150 mm in length on a side of the end cab having the buffer system, after attachment of the buffer system to the end cab locomotive.

11. The buffer system according to claim 10, which further comprises:

a crash element with a center having a receiving space;

said buffer having a buffer housing projecting into said receiving space, said buffer housing being surrounded by said crash element; and said buffer flange of said buffer being fastened to said crash element.

12. An end cab locomotive for switching operations, the end cab locomotive comprising:

buffer systems including a first buffer system having a buffer with a buffer plane;

an end cab;

a switchman's footstep disposed in front of said end cab on a side of said end cab having said first buffer system;

said switchman's footstep being disposed to locate said buffer plane of said buffer of said first buffer system in front of said switchman's footstep upon said buffer being completely elastically pushed in;

an external region of the end cab locomotive;

a banister arrangement including a banister element; and a holding element receiving said banister element and permitting said banister element to rotate about an axis of rotation;

said holding element being disposed in said external region of the end cab locomotive and orienting the axis of rotation vertically.

13. The end cab locomotive according to claim 12, which further comprises a plurality of locking elements configured and disposed to releasably fix said banister element in a predetermined position.

14. The end cab locomotive according to claim 13, wherein said banister element is configured to be fixed in two different positions corresponding to an angle of rotation of at least 70° about the axis of rotation.

15. The end cab locomotive according to claim 14, wherein said angle of rotation is at least 80° about the axis of rotation.

16. The end cab locomotive according to claim 14, wherein said angle of rotation is 90° about the axis of rotation.

17. An end cab locomotive for switching operations, the end cab locomotive comprising:

buffer systems including a first buffer system having a buffer with a buffer plane;

an end cab;

a switchman's footstep disposed in front of said end cab on a side of said end cab having said first buffer system;

said switchman's footstep being disposed to locate said buffer plane of said buffer of said first buffer system in front of said switchman's footstep upon said buffer being completely elastically pushed in;

a switching coupling and a catch device for said switching coupling;

said catch device including a lock, a catch body with an end stop, a right side stop and a left side stop together forming a holding body having an internal region being delimited on three sides and having an open side being lockable by said lock;

said open side being dimensioned to permit said switching coupling to be moved through said open side into said internal region; and said catch device having at least one of at least one elastic stop element or an elastically mounted stop element on one of said stops.

* * * * *